US010053329B2

(12) United States Patent
Wilcoxon

(10) Patent No.: US 10,053,329 B2
(45) Date of Patent: Aug. 21, 2018

(54) AUTOMATED AISLE RUNNER

(71) Applicant: Janice V Wilcoxon, Pleasant Prairie, WI (US)

(72) Inventor: Janice V Wilcoxon, Pleasant Prairie, WI (US)

( * ) Notice: Subject to any disclaimer, the term of this patent is extended or adjusted under 35 U.S.C. 154(b) by 20 days.

(21) Appl. No.: 15/222,834

(22) Filed: Jul. 28, 2016

(65) Prior Publication Data

US 2017/0029240 A1 Feb. 2, 2017

Related U.S. Application Data

(60) Provisional application No. 62/197,697, filed on Jul. 28, 2015.

(51) Int. Cl.
*B65H 75/44* (2006.01)

(52) U.S. Cl.
CPC ..... *B65H 75/4402* (2013.01); *B65H 75/4471* (2013.01); *B65H 75/4486* (2013.01)

(58) Field of Classification Search
CPC ..... B65H 75/4402; B65H 75/4471; B65H 75/4486
See application file for complete search history.

(56) References Cited

U.S. PATENT DOCUMENTS

| | | | | |
|---|---|---|---|---|
| 4,991,789 A * | 2/1991 | Buerger | A47G 27/0287 242/390.8 |
| 7,597,381 B2 * | 10/2009 | Hespeler | B60P 3/36 296/156 |
| 7,677,624 B1 * | 3/2010 | Koski | B60J 7/085 296/1.07 |
| 2012/0104014 A1 * | 5/2012 | Hamer | B65D 75/42 221/1 |

* cited by examiner

*Primary Examiner* — Sang K Kim

(57) ABSTRACT

An automated aisle runner includes an automated control unit and an aisle runner. The automated control unit includes a housing and a runner roller, wherein the runner roller is rotatably mounted within the housing. A fixed end of the aisle runner is connected to the runner roller, while a runner body is disposed around the runner roller, such that the runner body is wound around and unwound from the runner roller as the runner roller is rotated by a motor. A guide assembly is provided to ensure the aisle runner is extended or retracted in a straight, smooth manner, eliminating problematic tangling. A plurality of lights is positioned along the runner body, providing enhanced visual effects for the aisle runner, while a speaker provides audial effects. A microcontroller allows a user to control the color and pattern of the plurality of lights and the audio files played through the speaker.

18 Claims, 13 Drawing Sheets

AUTOMATED AISLE RUNNER

The current application claims a priority to the U.S. Provisional Patent application Ser. No. 62/197,697 filed on Jul. 28, 2015.

FIELD OF THE INVENTION

The present invention relates generally to aisle runners. More specifically, the present invention provides an automated control unit for dispensing and retracting an aisle runner.

BACKGROUND OF THE INVENTION

Aisle runners are utilized to provide a decorative walkway at events such as weddings, red carpet events, proms, church affairs, business affairs, school affairs, and community events. While aisle runners visually enhance the environment in which they are placed, the installation of the aisle runners can often be quite difficult. Ensuring that the aisle runner is laid down in a straight, flat manner can often be a daunting task, especially if the material of the aisle runner is heavy. Rarely is the placement of an aisle runner a smooth transition. Often times the aisle runner becomes twisted and tangled, becoming a distraction. An ill placed aisle runner can be visually displeasing and in turn provide the opposite effect intended. Furthermore, the typical aisle runner is difficult to roll up and store when it is no longer needed. It is particularly difficult to ensure that the aisle runner rolls up in a perfect cylindrical fashion, which in turn makes it more difficult to properly align the aisle runner the next time it is used.

Therefore it is an object of the present invention to provide an automated aisle runner that allows an aisle runner to be automatically extended from or retracted into an automated control unit. The present invention ensures that the aisle runner is placed down in a straight, smooth manner. The aisle runner has a runner body that is disposed about a runner roller rotatably mounted within a housing. The motor can be actuated in both directions in order to spin the runner roller and in turn extend or retract the aisle runner. A guide assembly is also provided to assist in the extension and retraction of the aisle runner, ensuring the aisle runner is properly placed and properly stored. Furthermore, the present invention includes a plurality of lights and a speaker that provide enhanced visual and audial effects respectively. The plurality of lights and the speaker are controlled by a microcontroller, wherein a user can determine the color and pattern of the plurality of lights and the audio files that are played through the speaker.

DETAIL DESCRIPTIONS OF THE INVENTION

All illustrations of the drawings are for the purpose of describing selected versions of the present invention and are not intended to limit the scope of the present invention.

The present invention is an automated aisle runner that alleviates the difficulties in lying down a typical aisle runner. Furthermore, the present invention provides additional visual and audial effects to the traditional aisle runner. In reference to FIG. 4, the automated aisle runner comprises an aisle runner 1 and an automated control unit 2, wherein the automated control unit 2 stores and dispenses the aisle runner 1.

Figure 9:
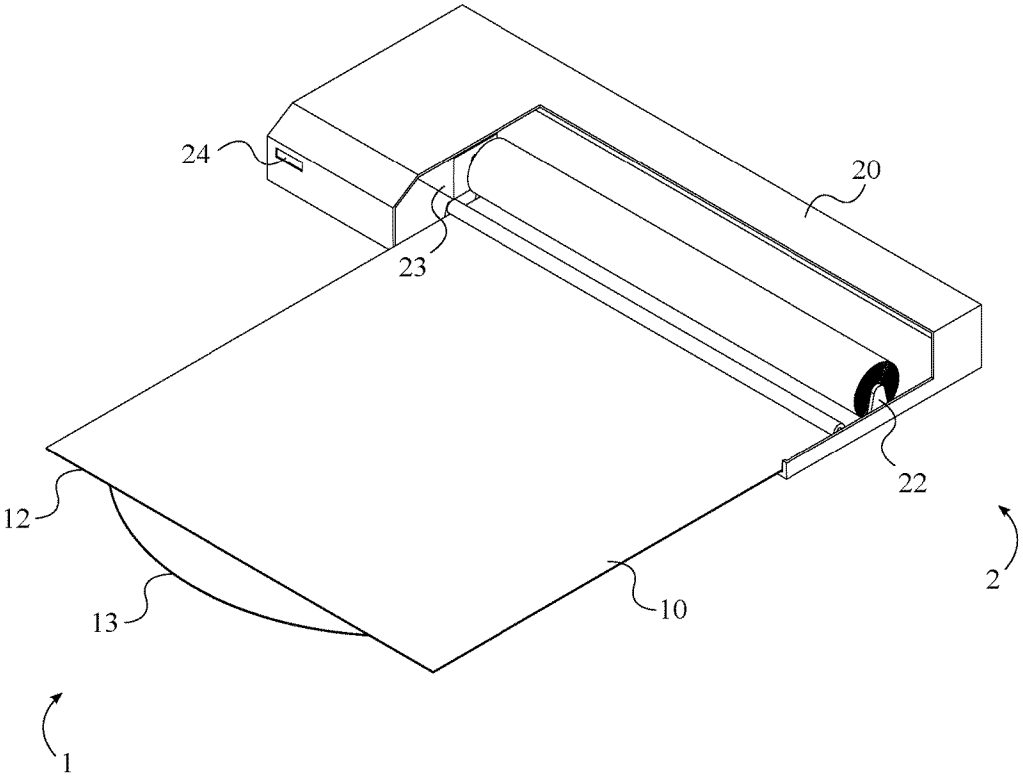
FIG. 9 is a sectional view depicting the runner body being disposed about the runner roller.
Figure 10:
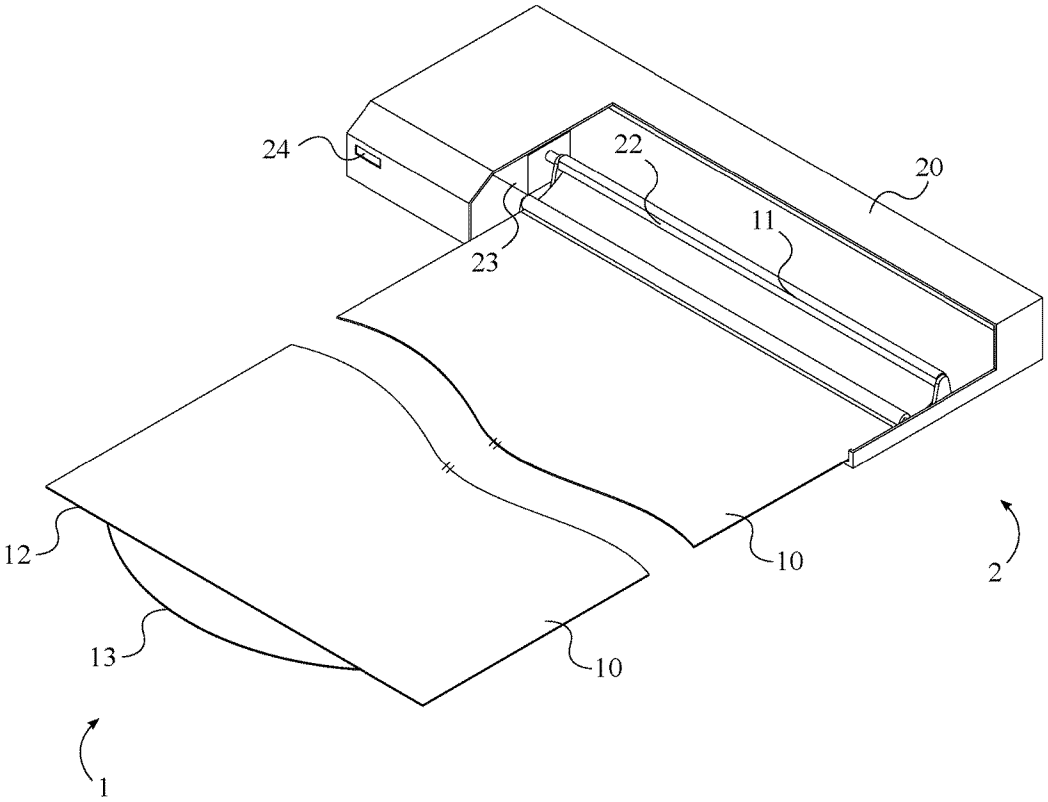
FIG. 10 is a sectional view depicting the fixed end of the aisle runner being connected to the runner roller.

The aisle runner 1 is a decorative length of material that is laid across the chosen walking surface and may be designed for use in many events, such as weddings, red carpet events, proms, church affairs, businesses, schools, community events, etc. A variety of materials may be used to construct the aisle runner 1 in a variety of colors and designs. The aisle runner 1 comprises a runner body 10, a fixed end 11, and a free end 12; the runner body 10 being the length of material in the chosen design, and the fixed end 11 and the free end 12 being positioned opposite each other along the runner body 10. The runner body 10 is wound within the automated control unit 2 as depicted in FIG. 9, wherein the fixed end 11 provides an anchored connection to the automated control unit 2 as depicted in FIG. 10. Meanwhile, the free end 12 is the terminal end of the aisle runner 1 that is extended away from the automated control unit 2 when the aisle runner 1 is dispensed.

In reference to FIG. 9, the automated control unit 2 provides a containment unit for the aisle runner 1 and controls the extension and retraction of the aisle runner 1. The automated control unit 2 comprises a housing 20, a runner feed opening 21, a runner roller 22, a motor 23, and an actuator 24. The housing 20 encases the aisle runner 1, wherein the runner body 10 is disposed around the runner roller 22. The runner roller 22 is rotatably coupled to the motor 23 and is rotatably mounted within the housing 20, such that the runner body 10 can be wound and unwound from the runner roller 22 by rotating the runner roller 22. The motor 23 is operably coupled to the actuator 24 in order to control the rotational direction and speed of the motor 23, and in turn the rotational direction and speed of the runner roller 22; the motor 23 driving the rotation of the runner roller 22.

The runner feed opening 21 traverses through the housing 20 and provides an open section through which the aisle runner 1 may be dispensed and retracted. As the runner body 10 is unwound from the runner roller 22, the runner body 10 is expelled from the housing 20 through the runner feed opening 21; the free end 12 first traversing through the runner feed opening 21. When the runner body 10 is wound around the runner roller 22, the runner body 10 is retracted into the housing 20 through the runner feed opening 21. The runner feed opening 21 is sufficiently large to allow the runner body 10 to smoothly traverse through the runner feed opening 21, without the runner body 10 becoming tangled or distraught.

The actuator 24 is a control that dictates the supply of power to the motor 23 in order to rotate the runner roller 22 and wind or unwind the runner body 10. In one embodiment of the present invention, the actuator 24 is a power switch, wherein a user can manually turn the motor 23 on and off, as well as dictate the rotational direction of the motor 23. In another embodiment of the present invention, the actuator 24 is a motion sensor, wherein the motion sensor detects movement and extends or retracts the runner body 10. In yet other embodiments of the present invention, the power switch may be used in combination with the motion sensor, wherein the power switch dictates the rotational direction of the motor 23, while the motion sensor dictates the extension or retraction of the runner body 10.

The present invention further comprises a guide assembly to assist the automated control unit 2 in dispensing and retracting the runner body 10. The guide assembly helps to maintain the runner body 10 in a smooth, untangled formation, such that the runner body 10 can be readily unwound from or wound around the runner roller 22. The guide assembly has many configurations and may include a guide wheel 30, a subsequent guide wheel 32, a guide wire 40, a subsequent guide wire 42, a wire roller 50, a guide track 60, and a subsequent guide track 62. The specific configuration may depend on the needs of the user and/or the type of material of the aisle runner 1.

Figure 8:
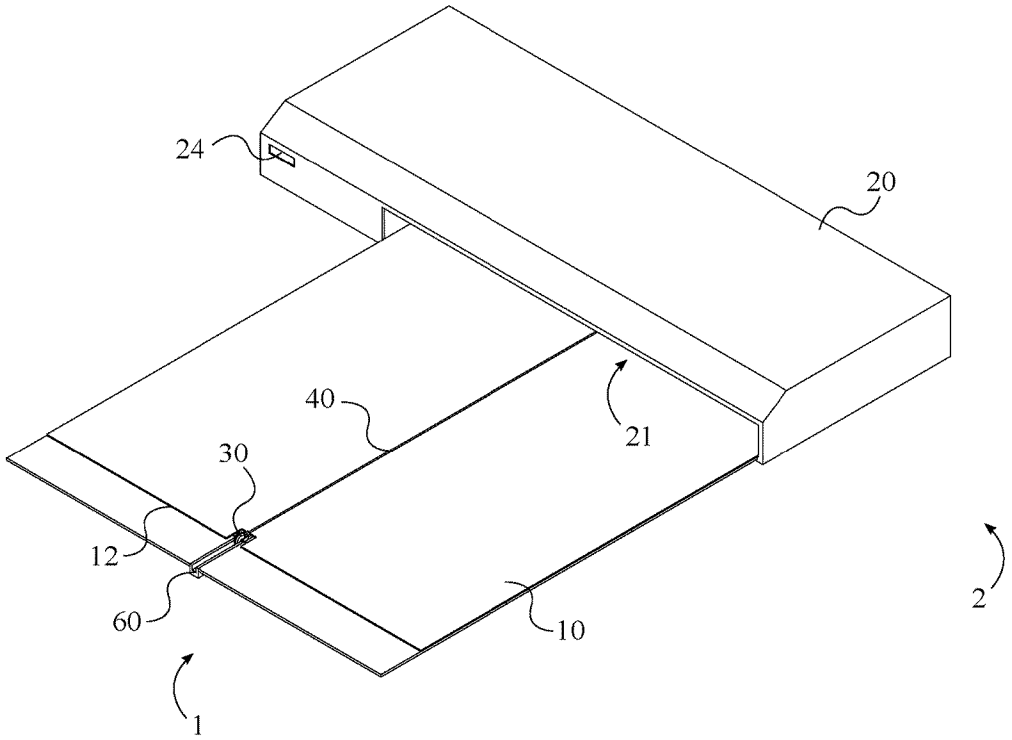
FIG. 8 is a perspective view depicting the guide wheel being centrally positioned about the runner body.

In reference to FIG. 8, in a first embodiment, the guide wheel 30 is rotatably connected to the runner body 10 and is positioned about the free end 12. More specifically, the guide wheel 30 is centrally positioned along the free end 12. Meanwhile, the wire roller 50 is rotatably mounted within the housing 20 and positioned in between the runner roller 22 and the runner feed opening 21. The guide wire 40 is terminally connected to the wire roller 50 and the guide wheel 30, wherein the guide wire 40 is coiled around the wire roller 50. The guide wheel 30 assists the runner body 10 is traversing across the ground as the runner body 10 is extended or retracted from the housing 20, and helps direct the runner body 10 in a straight line. As the runner body 10 is extended, the guide wire 40 is uncoiled from the wire roller 50. Meanwhile, as the runner body 10 is retracted, the guide wire 40 is coiled around the wire roller 50. The wire roller 50 may be motorized or rotatably coupled to the runner roller 22 in order to coil and uncoil the guide wire 40.

Figure 5:
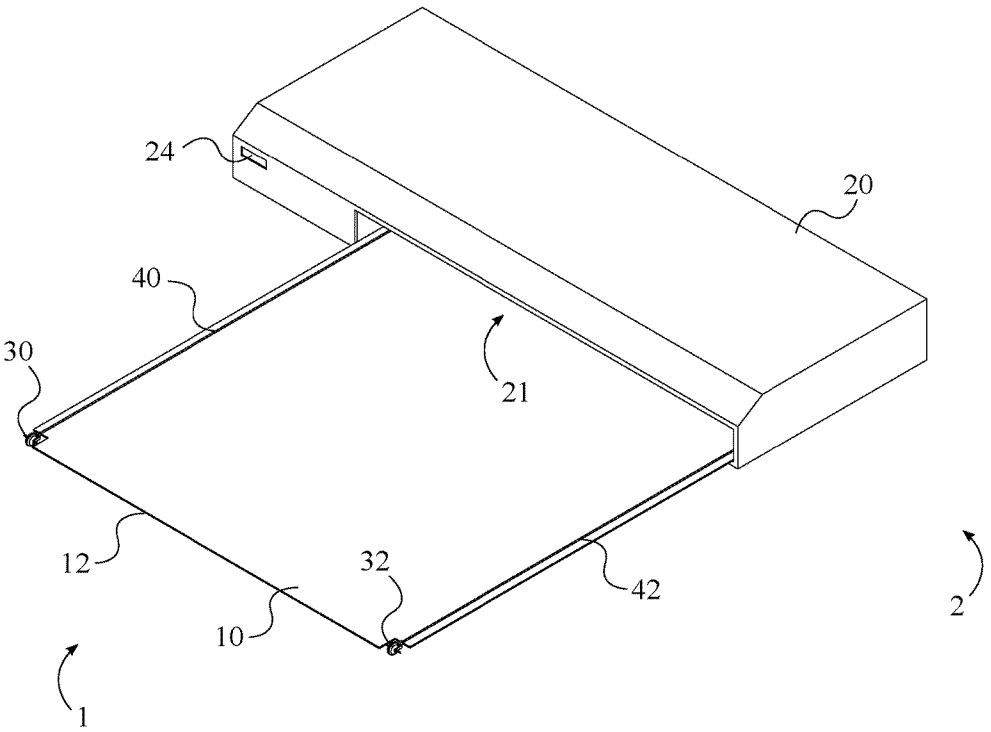
FIG. 5 is a perspective view depicting the guide wire being connected to the guide wheel and the subsequent guide wire being connected to the subsequent guide wheel.
Figure 6:
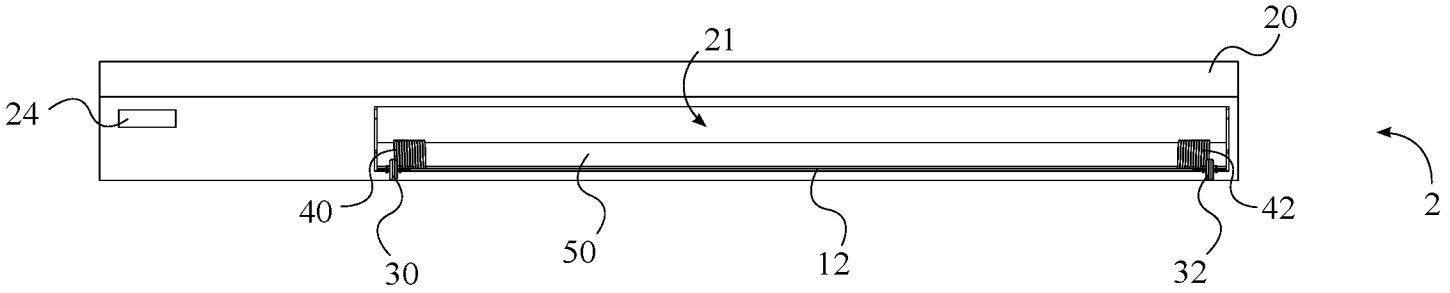
FIG. 6 is a front elevational view depicting the guide wire and the subsequent guide wire being coiled around the wire roller.

In reference to FIG. 5-6, in a second embodiment, the subsequent guide wheel 32 and the subsequent guide wire 42 are used in conjunction with the guide wheel 30 and the guide wire 40. Similar to guide wheel 30, the subsequent guide wheel 32 is rotatably connected to the runner body 10 and is positioned about the free end 12. The subsequent guide wire 42 is terminally connected to the wire roller 50 and the subsequent guide wheel 32, wherein the subsequent guide wire 42 is coiled around the wire roller 50. The subsequent guide wheel 32 is positioned opposite the guide wheel 30 across the free end 12, such that the guide wire 40 and the subsequent guide wire 42 traverse along opposite sides of the runner body 10. The guide wheel 30 and the subsequent guide wheel 32 assist the runner body 10 is traversing across the ground as the runner body 10 is extended or retracted from the housing 20, and help direct the runner body 10 in a straight line. As the runner body 10 is extended, the guide wire 40 and the subsequent guide wire 42 are uncoiled from the wire roller 50. Meanwhile, as the runner body 10 is retracted, the guide wire 40 and the subsequent guide wire 42 are coiled around the wire roller 50. The wire roller 50 may be motorized or rotatably coupled to the runner roller 22 in order to coil and uncoil the subsequent guide wire 42.

Figure 7:
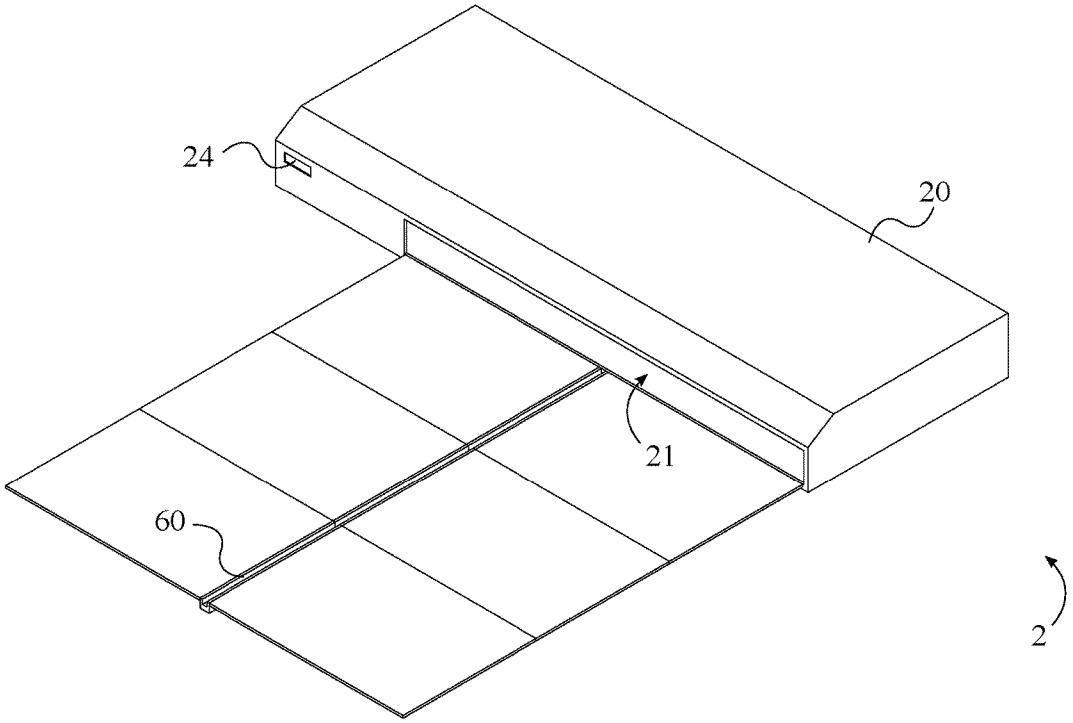
FIG. 7 is perspective view depicting the guide track in conjunction with the support platform, wherein the guide track is centrally positioned.

In a third embodiment, the guide wheel 30 is rotatably connected to the runner body 10 and is centrally positioned about the free end 12. Meanwhile, the guide track 60 is adjacently connected to the housing 20 and positioned adjacent to the runner feed opening 21 as depicted in FIG. 7. More specifically, the guide track 60 is centrally positioned with the runner feed opening 21. The guide wheel 30 is linearly retained by the guide track 60, such that as the runner body 10 is extended from or retracted into the housing 20, the guide wheel 30 linearly traverses along the guide track 60 away from or towards the housing 20. As such, the guide track 60, in combination with the guide wheel 30, assists in extending or retracting the runner body 10 in a straight, smooth manner.

Figure 1:
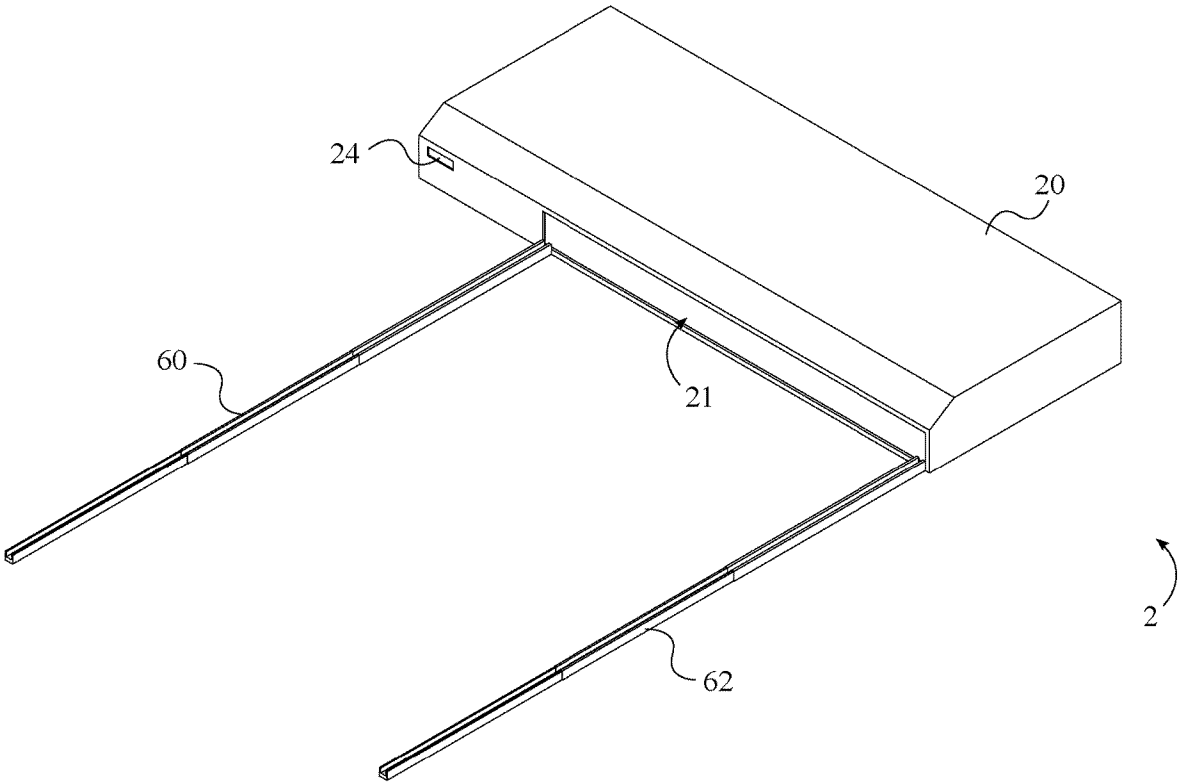
FIG. 1 is a perspective view depicting the guide track and the subsequent guide track being telescopically extended.
Figure 2:
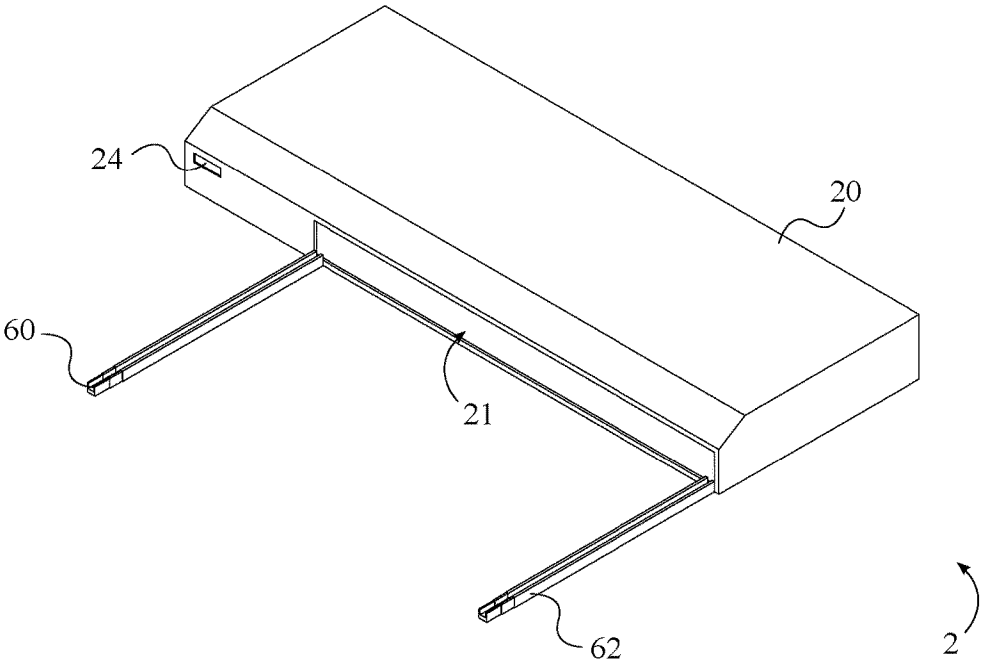
FIG. 2 is a perspective view depicting the guide track and the subsequent guide track being telescopically retracted.
Figure 3:
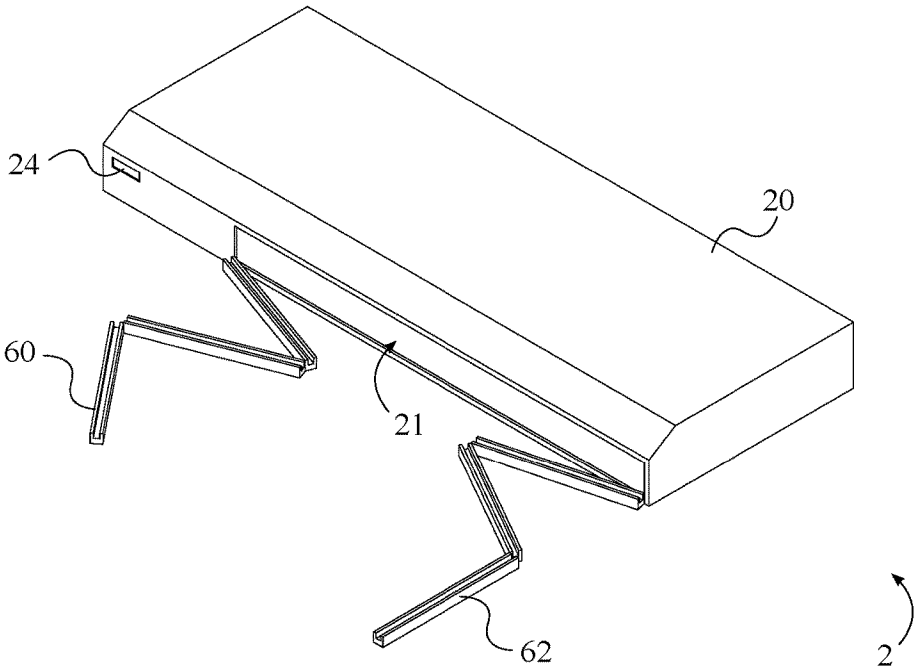
FIG. 3 is a perspective view depicting the guide track and the subsequent guide track being hingedly collapsible.

The guide track 60 is designed to be collapsible, such that the guide track 60 can be made more compact for transportation and storage when the aisle runner 1 is not deployed. The guide track 60 can be designed to be collapsible in many ways. In one embodiment, the guide track 60 is telescopically collapsible as depicted in FIG. 1-2, wherein the guide track 60 comprises a plurality of sections. Adjacent sections of the plurality of sections are slidably engaged with each other, allowing the guide track 60 to be extended and retracted. In another embodiment, the guide track 60 is hingedly collapsible as depicted in FIG. 3, wherein the guide track 60 again comprises the plurality of sections. However, in the hingedly collapsible configuration, the adjacent sections are hingedly connected to each other, such that the guide track 60 can be folded and unfolded by pivoting each of the plurality of sections.

In reference to FIG. 7-8, a support platform may also be utilized in conjunction with the guide track 60. The support platform provides a flat surface that extends away from the housing 20, onto which the runner body 10 is extended. The support platform comprises a first platform and a second platform that are both adjacently connected to the guide track 60. The first platform and the second platform are positioned opposite each other about the guide track 60, wherein the first platform and the second platform traverse along the guide track 60. When using the support platform, the guide track 60 is hingedly collapsible along with the first platform and the second platform. The first platform comprises a first plurality of sections, while the second platform comprises a second plurality of sections; adjacent sections of both the first plurality of sections and the second plurality of sections being hingedly connected to each other. In this way, both the first platform and the second platform are folded and unfolded in conjunction with the guide track 60.

Figure 4:
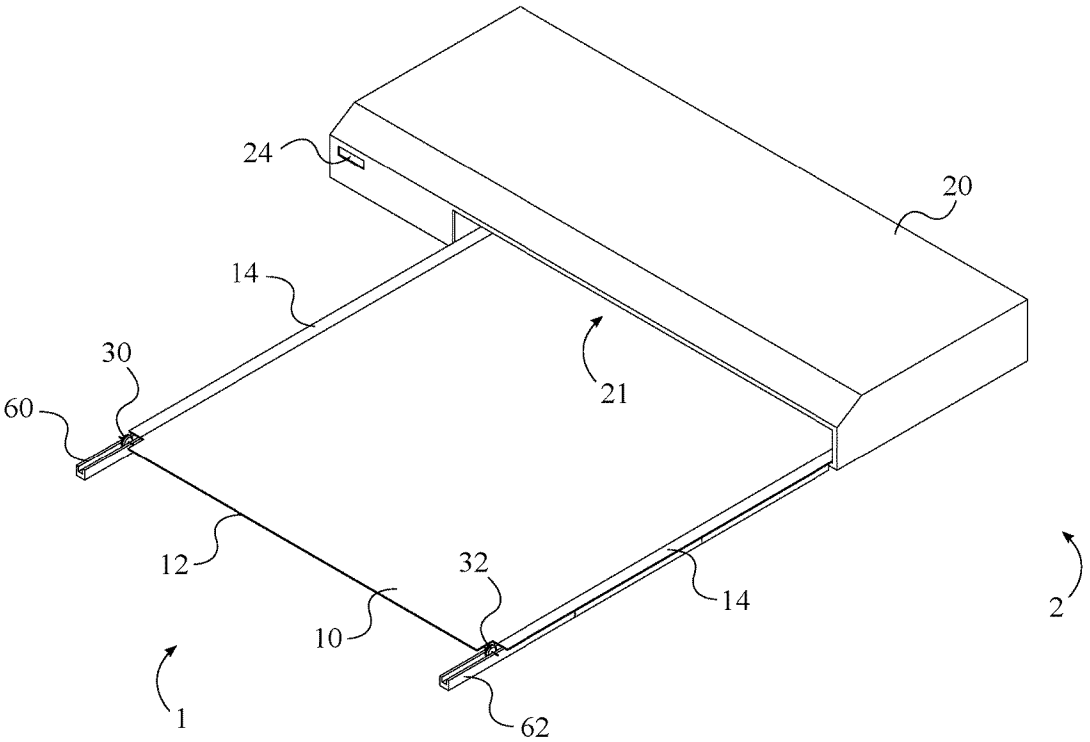
FIG. 4 is a perspective view depicting the aisle runner being extended from the automated housing, wherein the guide wheel is linearly retained by the guide track and the subsequent guide wheel is linearly retained by the subsequent guide track.

In reference to FIG. 4, in a fourth embodiment, the guide wheel 30 and the subsequent guide wheel 32 are rotatably connected to the runner body 10 and are positioned about opposite sides of the free end 12. Meanwhile, the guide track 60 and the subsequent guide track 62 are adjacently connected to the housing 20 and are positioned adjacent to the runner feed opening 21. More specifically, guide track 60 and the subsequent guide track 62 are positioned opposite each other across the runner feed opening 21. Similar to the guide wheel 30 and the guide track 60, the subsequent guide wheel 32 is linearly retained by the subsequent guide track 62, such that as the runner body 10 is extended from or retracted into the housing 20, the subsequent guide wheel 32 linearly traverses along the subsequent guide track 62 away from or towards the housing 20. As such, the guide wheel 30, in combination with the guide track 60, and the subsequent guide track 62, in combination with the subsequent guide wheel 32, assist in extending or retracting the runner body 10 in a straight, smooth manner.

Similar to the guide track 60, the subsequent guide track 62 is designed to be collapsible, such that the subsequent guide track 62 can be made more compact for transportation and storage when the aisle runner 1 is not deployed. The subsequent guide track 62 can be designed to be collapsible in many ways. In one embodiment, the subsequent guide track 62 is telescopically collapsible as depicted in FIG. 1-2, wherein the subsequent guide track 62 comprises a plurality of sections. Adjacent sections of the plurality of sections are slidably engaged with each other, allowing the subsequent guide track 62 to be extended and retracted. In another embodiment, the subsequent guide track 62 is hingedly collapsible as depicted in FIG. 3, wherein the subsequent guide track 62 again comprises the plurality of sections. However, in the hingedly collapsible configuration, the adjacent sections are hingedly connected to each other, such that the subsequent guide track 62 can be folded and unfolded by pivoting each of the plurality of sections.

In reference to FIG. 9-10, in some embodiments, the aisle runner 1 may further comprise a handle 13 that is integrated into the runner body 10 about the free end 12. The handle 13 allows a user to grasp the aisle runner 1 as the runner body 10 is being extended from or retracted into the housing 20. In this way, the user can guide the runner body 10, ensuring that the aisle runner 1 is extended or retracted in a straight, smooth manner. The handle 13 can also be utilized to manually extend the runner body 10 without the use of the motor 23.

In reference to FIG. 4, the aisle runner 1 further comprises a plurality of lights 14 that provide additional visual effects to the design of the runner body 10. The plurality of lights 14 is perimetrically connected to the runner body 10, wherein the plurality of lights 14 illuminates the edges of the runner body 10; the plurality of lights 14 being positioned along both sides of the runner body 10. Preferably, each of the plurality of lights 14 is a light emitting diode (LED), however, it is possible for other light sources to be utilized. The LED's may by arranged individually or in an LED strip that is positioned along each side of the runner body 10.

Figure 12:
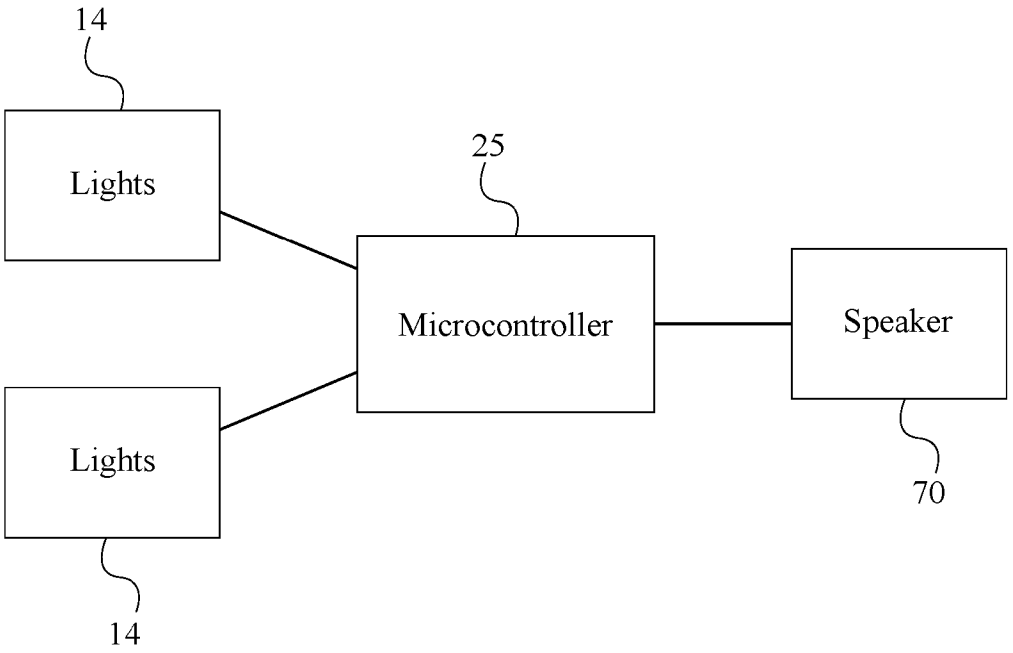
FIG. 12 is a diagram depicting the microcontroller being operably connected to the plurality of lights and the speaker.
Figure 13:
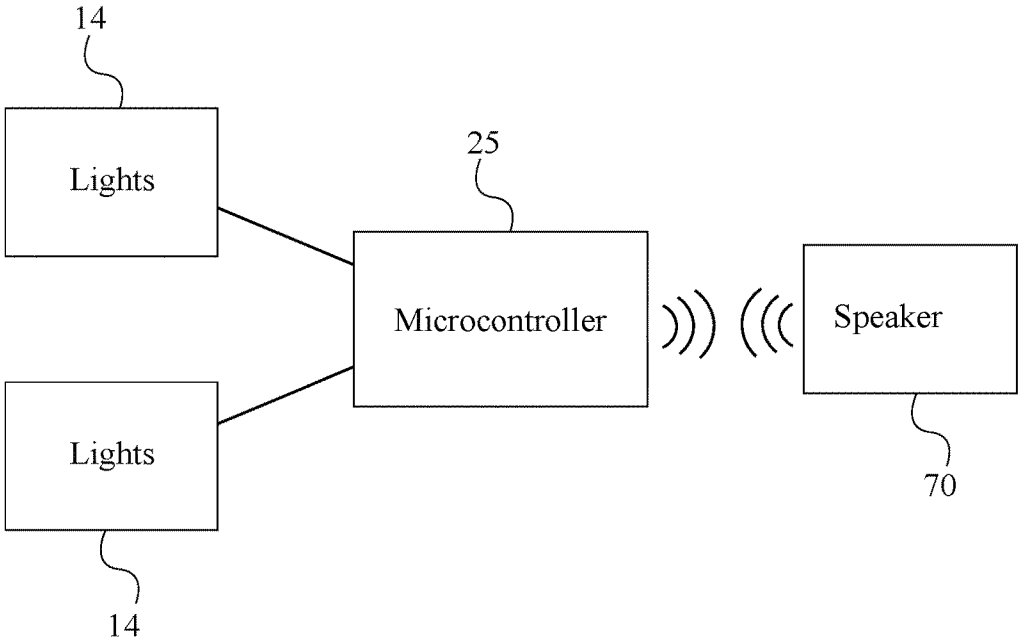
FIG. 13 is a diagram depicting the microcontroller being wirelessly connected to the speaker.

In reference to FIG. 12-13, the automated control unit 2 further comprises a microcontroller 25 that is positioned within the housing 20 and is operably connected to the plurality of lights 14. The plurality of lights 14 can emit a variety of colors of light and can be configured to constantly illuminate or flash or pulsate in a predetermined pattern. The microcontroller 25 dictates the color of each of the plurality of lights 14 and the pattern in which each of the plurality of lights 14 is illuminated. A control panel may also be provided, allowing a user to select the color of light and the light pattern, wherein the control panel is operably connected to the microcontroller 25.

The microcontroller 25 can also be used to dictate when the plurality of lights 14 is turned on and off. The plurality of lights 14 can be turned off and on through a power switch or using a sensor array that is electrically connected to the microcontroller 25. In one embodiment, the sensor array includes a motion sensor. When the motion sensor detects movement, a signal is relayed to the microcontroller 25, wherein the microcontroller 25 turns the plurality of lights 14 on in the desired pattern. In another embodiment, the sensor array includes a plurality of pressure sensors integrated into the runner body 10. When an individual walks across the runner body 10, the plurality of pressure sensors relays signals back to the microcontroller 25, wherein the microcontroller 25 turns on the plurality of lights 14.

Figure 11:
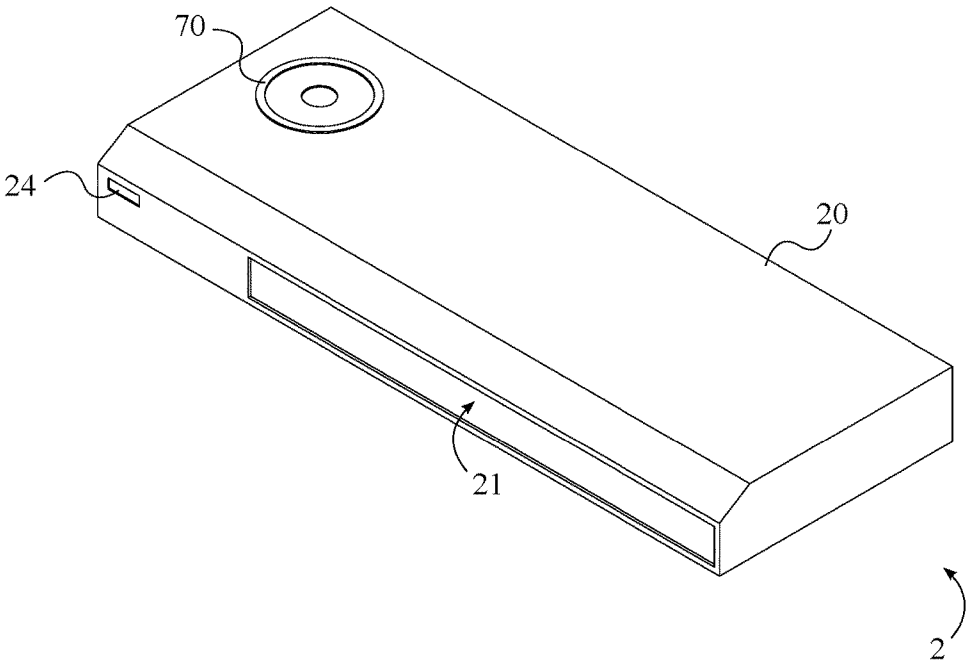
FIG. 11 is a perspective view depicting the speaker being integrated into the housing.

The present invention further includes a speaker 70 that is used to provide audial effects in addition to the visual effects of the runner body 10. The microcontroller 25 is operably connected to the speaker 70 as depicted in FIG. 12, wherein the microcontroller 25 dictates the audio files that are plated through the speaker 70. The microcontroller 25 may be preprogrammed with audio files, or audio files may be uploaded to the microcontroller 25. In one embodiment, the speaker 70 is integrated into the housing 20 as depicted in FIG. 11, wherein music or sound effects are played directly from the automated control unit 2. In another embodiment, the speaker 70 is wirelessly connected to the microcontroller 25 as depicted in FIG. 13, such that the speaker 70 can be positioned in a remote location relative to the automated control unit 2.

Some embodiments of the present invention may further include a three dimensional (3D) hologram display unit. The 3D hologram display unit is utilized to project 3D images on or around the aisle runner 1. The 3D hologram display unit can be integrated into the aisle runner 1, the automated control unit 2, or both.

Other optional components for the present invention include a remote control, a cleaning kit, and a storage bag. The remote control allows a user to wirelessly interact with the microcontroller 25 in order to control the plurality of lights 14, the speaker 70, and the extension or retraction of the aisle runner 1. Meanwhile, the cleaning kit provides the necessary equipment for maintaining the automated control unit 2 and the aisle runner 1 in working order. The storage bag provides an enclosure to hold, transport, and store the automated control unit 2 in, while the aisle runner 1 is in the retracted position.

Although the invention has been explained in relation to its preferred embodiment, it is to be understood that many other possible modifications and variations can be made without departing from the spirit and scope of the invention as hereinafter claimed.

What is claimed is:

1. An automated aisle runner comprises:

an aisle runner;

an automated control unit;

the aisle runner comprising a plurality of lights, a runner body, a fixed end, and a free end;

the automated control unit comprising a housing, a runner feed opening, a runner roller, a motor, and an actuator;

the runner feed opening traversing through the housing;

the runner roller being rotatably mounted within the housing;

the runner roller being rotatably coupled to the motor;

the actuator being operably coupled to the motor to control rotation of the runner roller;

the fixed end and the free end being terminally positioned opposite each other along the runner body;

the fixed end being adjacently connected to the runner roller; and the runner body being disposed about the runner roller; and the plurality of lights being perimetrically connected to the runner body.

2. The automated aisle runner as claimed in claim 1 comprises:

the automated control unit further comprising a microcontroller;

the microcontroller being positioned within the housing; and the microcontroller being operably connected to the plurality of lights.

3. The automated aisle runner as claimed in claim 1 comprises:

a guide wheel;

the guide wheel being rotatably connected to the runner body; and the guide wheel being positioned about the free end.

4. The automated aisle runner as claimed in claim 3 comprises:

a guide wire;

a wire roller;

the wire roller being rotatably mounted within the housing;

the guide wire being terminally coupled to the wire roller and the guide wheel; and the guide wire being coiled around the wire roller.

5. The automated aisle runner as claimed in claim 3 comprises:

a guide track;

the guide track being adjacently connected to the housing;

the guide track being positioned adjacent to the runner feed opening; and the guide wheel being linearly retained by the guide track.

6. The automated aisle runner as claimed in claim 5, wherein the guide track is telescopically collapsible.

7. The automated aisle runner as claimed in claim 5, wherein the guide track is hingedly collapsible.

8. The automated aisle runner as claimed in claim 3 comprises:

a subsequent guide wheel;

the subsequent guide wheel being rotatably connected to the runner body; and the subsequent guide wheel being positioned opposite the guide wheel across the free end.

9. The automated aisle runner as claimed in claim 8 comprises:

a subsequent guide wire;

a wire roller;

the wire roller being rotatably mounted within the housing;

the subsequent guide wire being terminally coupled to the wire roller and the subsequent guide wheel; and the subsequent guide wire being coiled around the wire roller.

10. The automated aisle runner as claimed in claim 8 comprises:

a subsequent guide track;

the subsequent guide track being adjacently connected to the housing;

the subsequent guide track being positioned adjacent to the runner feed opening; and the subsequent guide wheel being linearly retained by the subsequent guide track.

11. The automated aisle runner as claimed in claim 10, wherein the subsequent guide track is telescopically collapsible.

12. The automated aisle runner as claimed in claim 10, wherein the subsequent guide track is hingedly collapsible.

13. The automated aisle runner as claimed in claim 1 comprises:

the aisle runner further comprising a handle; and the handle being integrated into the runner body about the free end.

14. The automated aisle runner as claimed in claim 1 comprises:

a speaker;

the automated control unit further comprising a microcontroller;

the microcontroller being positioned within the housing; and the microcontroller being operably connected to the speaker.

15. The automated aisle runner as claimed in claim 14, wherein the speaker is integrated into the housing.

16. The automated aisle runner as claimed in claim 14, wherein the speaker is wirelessly connected to the microcontroller.

17. The automated aisle runner as claimed in claim 1, wherein the actuator is a power switch.

18. The automated aisle runner as claimed in claim 1, wherein the actuator is a motion sensor.

* * * * *